US012378054B2

(12) United States Patent
Taglini et al.

(10) Patent No.: US 12,378,054 B2
(45) Date of Patent: Aug. 5, 2025

(54) SEALED SINGLE-DOSE PACKAGE WITH BREAK OPENING

(71) Applicant: EASYSNAP TECHNOLOGY S.R.L., Castellazzo Bormida (IT)

(72) Inventors: Andrea Taglini, Castellazzo Bormida (IT); Tomas Di Girolamo, Castellazzo Bormida (IT)

(73) Assignee: EASYSNAP TECHNOLOGY S.R.L., Alessandria (IT)

( * ) Notice: Subject to any disclaimer, the term of this patent is extended or adjusted under 35 U.S.C. 154(b) by 108 days.

(21) Appl. No.: 18/287,712

(22) PCT Filed: Apr. 20, 2022

(86) PCT No.: PCT/IB2022/053689

§ 371 (c)(1),
(2) Date: Oct. 20, 2023

(87) PCT Pub. No.: WO2022/224160

PCT Pub. Date: Oct. 27, 2022

(65) Prior Publication Data

US 2024/0208709 A1 Jun. 27, 2024

(30) Foreign Application Priority Data

Apr. 23, 2021 (IT) ..... 102021000010379

(51) Int. Cl.
*B65D 75/58* (2006.01)
*B65D 75/26* (2006.01)

(52) U.S. Cl.
CPC ..... *B65D 75/585* (2013.01); *B65D 75/26* (2013.01)

(58) Field of Classification Search
CPC ..... B65D 75/585; B65D 75/26
USPC ..... 383/207; 206/469
See application file for complete search history.

(56) References Cited

U.S. PATENT DOCUMENTS 3,986,640 A 10/1976 Redmond
4,236,652 A * 12/1980 Beguhn ..... B32B 15/09 222/541.6
6,230,894 B1 * 5/2001 Danville ..... B65D 75/327 206/532
2014/0231296 A1 * 8/2014 Reggio ..... B65D 75/585 206/484

(Continued)

FOREIGN PATENT DOCUMENTS

EP 2628691 A1 8/2013
EP 2944579 A2 11/2015

(Continued)

OTHER PUBLICATIONS

International Search Report for International Patent Application No. PCT/IB2022/053689, mailed Aug. 3, 2022.

(Continued)

*Primary Examiner* — Jes F Pascua
(74) *Attorney, Agent, or Firm* — CANTOR COLBURN LLP

(57) ABSTRACT

A sealed single-dose package having a semi-rigid sheet and a flexible sheet that pierce a pocket for a dose of a product is provided. On a rear face of the semi-rigid sheet an outer incision for breaking the package open is provided. The semi-rigid sheet has a supporting layer having the rear face made of paper, cardboard or other cellulose-based material.

16 Claims, 10 Drawing Sheets

(56) References Cited

U.S. PATENT DOCUMENTS

2015/0307260 A1* 10/2015 Reggio ..... B65D 83/0445
206/531

FOREIGN PATENT DOCUMENTS

| | | | |
|---|---|---|---|
| IT | 201700149766 | A1 | 7/2019 |
| WO | 9706073 | A1 | 2/1997 |
| WO | 2008038074 | A2 | 4/2008 |
| WO | 2009040629 | A2 | 4/2009 |
| WO | 2015166453 | A1 | 11/2015 |
| WO | 2018130984 | A1 | 7/2018 |
| WO | 2019142143 | A1 | 7/2019 |
| WO | 2019142144 | A1 | 7/2019 |
| WO | 2019171322 | A1 | 9/2019 |

OTHER PUBLICATIONS

International Preliminary Report on Patentability for International Patent Application No. PCT/IB2022/053689; Mail date Jul. 28, 2023.

* cited by examiner

SEALED SINGLE-DOSE PACKAGE WITH BREAK OPENING

CROSS-REFERENCE TO RELATED APPLICATIONS

This application is a National Phase Application of PCT International Application PCT/IB2022/053689, having an International Filing Date of Apr. 20, 2022 which claims priority to Italian Application No. 102021000010379 filed Apr. 23, 2021, each of which is hereby incorporated by reference in its entirety.

FIELD OF THE INVENTION

The present invention relates to the field of packaging and in particular to the field of sealed single-dose packages with break opening, of the "one hand opening" type, i.e. openable by folding the package with one hand.

BACKGROUND OF THE INVENTION

These packages, by virtue of their indisputable practicality of use, have become considerably widespread; currently, several hundreds of millions of packages of this type are marketed every year in many industries, for example for food products, such as sauces and other condiments, and pharmaceutical products, such as eye drops and dermatological creams. Embodiment examples of these packages are illustrated in documents EP-A2-2076451, EP-A2-2205505, EP-A1-2628691, EP-A2-2944579, EP-A1-3137390, EP-A1-3568360, EP-A1-3740438, EP-A1-3740437, EP-A1-3762310 by the Applicant.

Given the enormous diffusion of such packages and a profound change in consumers' attitudes towards the issues of sustainability and environmental protection, the problem of correct disposal of the packages after use is now particularly felt. Such packages are substantially made from films of plastic material, which the consumer is today particularly critical in buying, and furthermore, after use, it is necessary that they be disposed of in a differentiated manner.

SUMMARY OF THE INVENTION

The object of the present invention is to provide a sealed single-dose package with break opening which meets the needs of the field and at the same time overcomes the aforementioned drawbacks.

Such object is achieved by a sealed single-dose package with break opening as described and claimed herein. Advantageous embodiments of the invention are also described.

BRIEF DESCRIPTION OF THE FIGURES

The features and advantages of the package according to the present invention will appear more clearly from the following description, made by way of an indicative and non-limiting example with reference to the drawings of the accompanying figures, in which.

DETAILED DESCRIPTION

Figure 1:
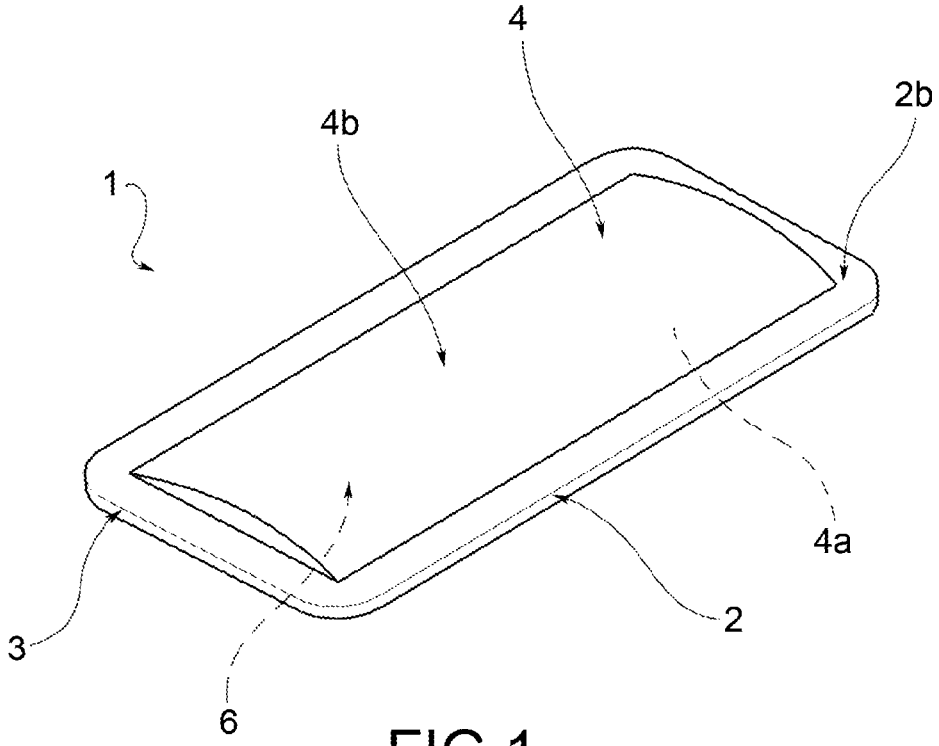
FIG. 1 shows a sealed single-dose package according to an embodiment of the present invention, shown from the front side.
Figure 2:
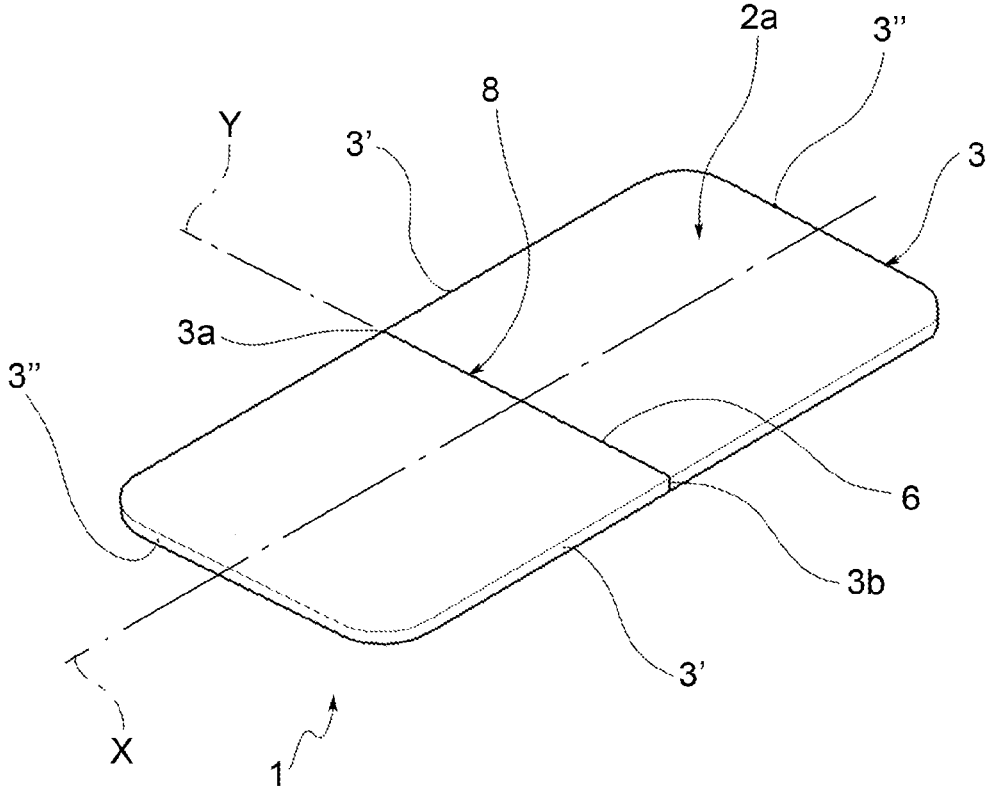
FIG. 2 shows the package of FIG. 1, shown from the rear side.
Figure 3:
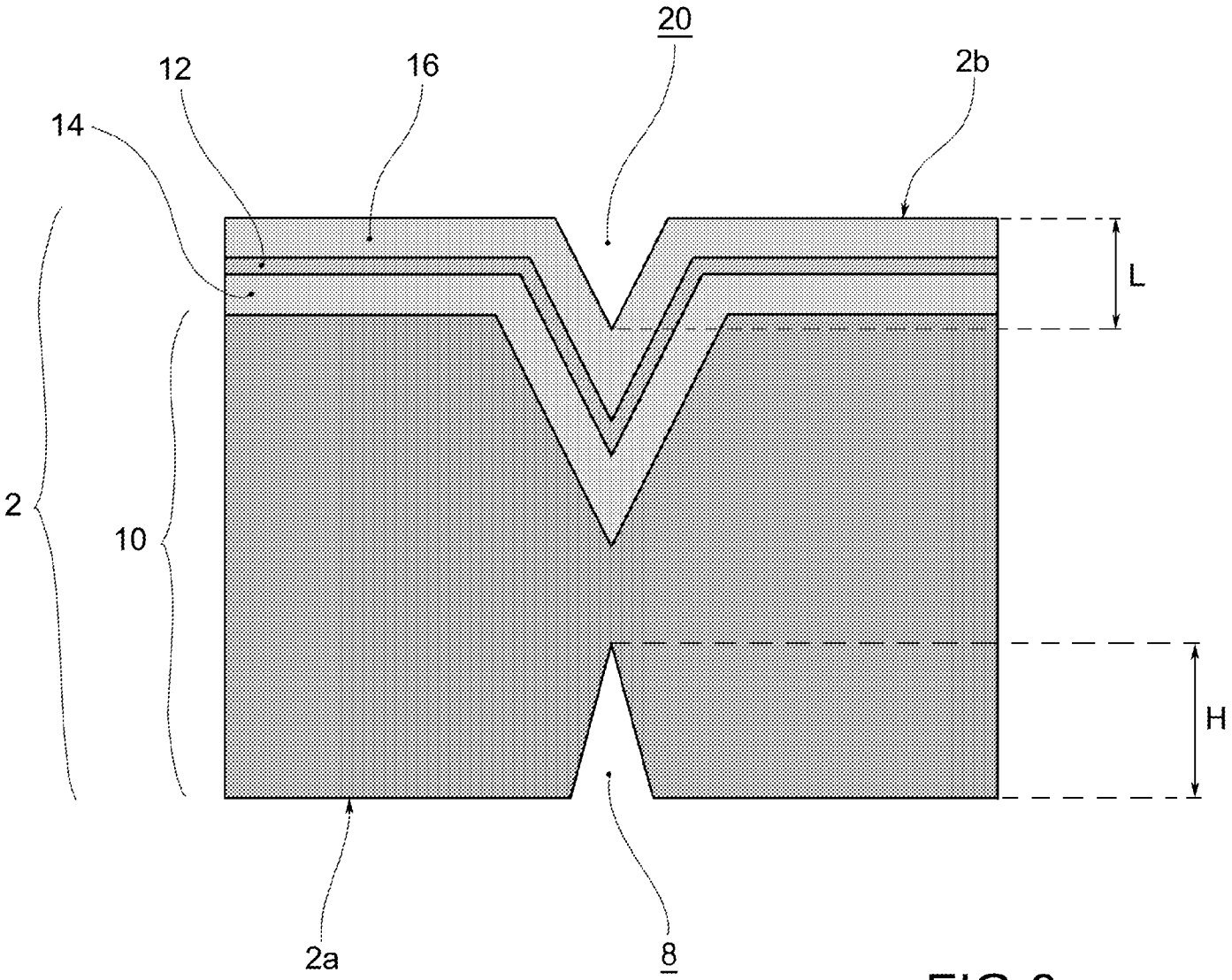
FIG. 3 shows a diagram of the multi-layer structure of a semi-rigid sheet of the package according to an embodiment of the invention.

With reference to the figures of the accompanying tables, reference numeral 1 denotes a sealed single-dose package with break opening. The package 1 comprises a semi-rigid sheet 2, delimited by a peripheral edge 3 and having a rear face 2*a* and an opposite front face 2*b*, and a flexible sheet 4, having an inner face 4*a* and an outer face 4*b*.

The flexible sheet 4 overlaps the semi-rigid sheet 2, so that the inner face 4*a* faces the front face 2*b*, and is welded thereto, so as to form an inner pocket 6 for containing one dose of a product, generally liquid, creamy or powdered.

For example, according to an embodiment, the semi-rigid sheet 2 has a rectangular shape and has opposite long sides 3' and opposite short sides 3"; the semi-rigid sheet 2 extends along a longitudinal axis X parallel to the long sides 3'.

On the rear face 2*a* of the semi-rigid sheet 2, at the pocket 6, there is an outer incision 8 which extends along an incision direction Y, for example transversal, that is, in the aforementioned embodiment, along a direction incident to the longitudinal axis X, preferably orthogonal thereto.

For example, the outer incision 8 joins two opposite points 3*a*, 3*b* of the peripheral edge 3; in the aforementioned embodiment, this means that it extends over the entire width of the rectangular semi-rigid sheet.

The semi-rigid sheet 2, which for example has a thickness of between 300-600 microns overall, is a multi-layer laminate comprising a supporting layer 10 having said rear face 2*a*. The supporting layer 10, single-layer or multi-layer, is made of paper, cardboard or other material mainly based on cellulose (i.e. based on cellulose for at least 50% by weight). The supporting layer 10 has, for example, a thickness of between 250-550 microns.

Preferably, internally, the semi-rigid sheet 2 comprises a barrier layer 12 suitable for providing a barrier against the passage of gas, and in particular the passage of oxygen; for example, the barrier layer 12 is mono-layer or multi-layer, aluminum or EVOH (Ethylene Vinyl alcohol), or combinations thereof. In variants where the barrier layer is multi-layer, some films may be made of non-barrier materials.

Alternatively, the supporting layer 10 has a film coated on the face opposite the front face 2*b*, wherein said coated film has barrier properties. Alternatively, the supporting layer 10 undergoes a chemical treatment such as to make it assume barrier properties, at least on the face opposite the rear face 2*a*.

On the side opposite the rear face 2*a*, and preferably between the supporting layer 10 and the barrier layer 12, the semi-rigid sheet 2 also comprises at least one intermediate layer 14, mono-layer or multi-layer, comprising an adhesive or polyethylene, preferably extruded, or polypropylene, preferably extruded, or other material binding with the supporting layer 10.

Furthermore, the semi-rigid sheet 2 comprises a final layer 16 having said front face 2*b*. The final layer 16, mono-layer or multi-layer, comprises polyethylene or polypropylene or a solder varnish or other material suitable for being welded to the flexible film 4.

Preferably, the outer incision 8 extends only through the supporting layer 10 of the semi-rigid sheet 2. Said incision has a depth H with respect to the front face 2*a*, typically variable transversely along the outer incision 8. For example, the depth is greatest in a central segment of the incision. Advantageously, such variation in depth along the incision ensures the opening at breakage in a controlled manner, preventing the break from being sudden and therefore the product from being projected outwards in a damaging manner.

For example, said outer incision 8 extends from the rear face 2*a* to the surface of the intermediate layer 14, without incising it.

According to a preferred embodiment, the final layer 16 has an inner incision 20 starting from the front face 2*b*.

Figure 4A:
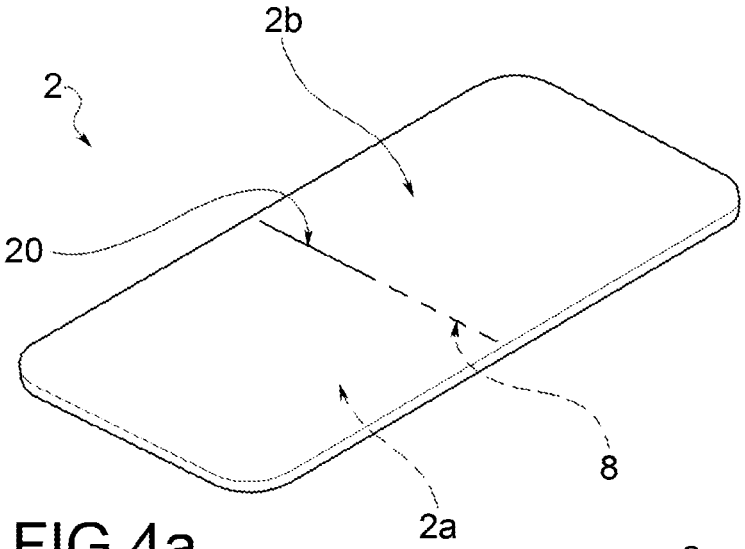
FIGS. 4*a* to 4*c* show further embodiments of the semi-rigid sheet according to the invention.

According to an embodiment, the inner incision 20 is misaligned with, i.e. not overlapping or only partially overlapping, the outer incision 8 (FIG. 4*a*). Advantageously, this feature allows conveniently exploiting the propagation properties of the fracture in the paper, of which the supporting layer 10 substantially consists; for paper, in fact, it is observed that the propagation of the fracture occurs preferentially in a transverse direction rather than in depth.

According to a further embodiment, the inner incision 20 is aligned with, i.e. completely overlapping, the outer incision 8.

The inner incision 20 has a depth L with respect to the front face 2*a*, typically variable transversely along the inner incision 20. For example, the depth is greatest in a central segment of the inner incision. Advantageously, this variation in depth along the incision also ensures the break opening in a controlled manner.

According to an embodiment, the inner incision 20 passes through the final layer 16, the intermediate layer 14 and the barrier layer 12, and the supporting layer 10 has barrier properties.

The flexible sheet 4 is a multi-layer laminate comprising an inner layer 30 having said inner face 4*a*. The inner layer 30, mono-layer or multi-layer, comprises polyethylene or polypropylene or a solder varnish or other material suitable for being welded to the semi-rigid film 2.

Externally, the flexible sheet 4 comprises an outer layer 32 having said outer face 4*b*. The outer layer 32, mono-layer or multi-layer, comprises paper, cardboard or other material mainly based on cellulose.

Furthermore, the flexible sheet 4 preferably comprises an intermediate layer 34 placed between the inner layer 30 and the outer layer 32. For example, the intermediate layer 34, mono-layer or multi-layer, has barrier properties and comprises aluminum or EVOH, and/or has binding properties with the inner layer 30 and with the outer layer 32.

Alternatively, the outer layer 32 has a film coated on the face opposite the outer face 4*b*, wherein said coated film has barrier properties.

According to an embodiment variant, the flexible sheet 4 has no intermediate layer and the inner layer is directly in contact with the outer layer.

Overall, the package 1 provides that the paper, cardboard or other material mainly based on cellulose of the semi-rigid sheet and the paper, cardboard or other material mainly based on cellulose of the flexible sheet together constitute at least 60% by weight of the entire (empty) package.

According to an embodiment of the package 1, a machine 100 is provided with a first roll station 102, wherein a first roll R1 consisting of a first wound web N1 is placed, wherein the first web N1 has the multi-layer configuration of the semi-rigid sheet 2.

The machine 100 further comprises a second roll station 104, wherein a second roll R2 consisting of a second wound web N2 is placed, wherein the second web N2 has the multi-layer configuration of the flexible sheet 4.

Preferably, the machine 100 comprises a printing station 106, for example comprising a plurality of printing units 108 in succession; the first web N1, unwound from the first roll R1, passes through the printing station 106, wherein it is printed, preferably on the face corresponding to the rear face of the semi-rigid sheet.

The machine 100 further comprises a cutting station 110 which is crossed by the first web N1 for making an outer incision and an inner incision.

To this end, the cutting station 110 comprises a first blade 112' and a first abutment 114', arranged opposite each other so that the first web N1 passes between the first blade 112' and the first abutment 114'; the first blade 112' is arranged so as to be able to incise a first surface of the first web N1, for example corresponding to the rear face 2*a*. The first blade 112' is capable of carrying out a forward movement which allows the first surface of the web to be incised, which on the other side rests against the first abutment 114', preferably mounted on an elastically yielding support.

The cutting station 110 also comprises a second blade 112" and a second abutment 114", arranged opposite each other so that the first web N1 passes between the second blade 112" and the second abutment 114"; the second blade 112" is arranged so as to be able to incise a second surface of the first web N1, for example corresponding to the front face 2*b*. The second blade 112" is capable of carrying out a forward movement which allows incising the second surface of the web, which on the other side rests against the second abutment 114", preferably mounted on an elastically yielding support.

According to an embodiment of the cutting station, the first blade 112' and the second abutment 114" are part of a single first rotating blade unit, just as the second blade 112" and the first abutment 114' are part of a single second rotating blade unit, arranged opposite the first.

According to a further embodiment of the cutting station, the first blade 112' and the first abutment 114' constitute a first module and the second blade 112" and the second abutment 114" constitute a second module, located downstream of the first.

The machine 100 further comprises a metering and sealing station 120 in which the first web N1 and the second web N2 converge. The two webs N1, N2 are first partially welded together so as to form a cavity capable of containing a product but still accessible from the outside; subsequently, a predefined amount of product is fed into said cavity; finally, the two webs are further welded together in order to seal the cavity. A combined web N3 is thus produced, in which the first and second webs N1, N2 are welded together and form a plurality of cavities containing the product.

The machine 100 finally comprises a shearing station 140 wherein the combined web N3 is sheared so as to separate the single sealed single-dose packages.

From what has been illustrated above regarding the method of manufacturing the package, it is also understood that the term "incision" does not exclusively indicate a cut that leads to the break of the structural continuity of the layers or films that make up a sheet; such "incision" may also appear as a more or less sharp depression, without breaking the material, due to a permanent compression of the material.

According to an embodiment variant, the inner incision and/or the outer incision have a longitudinal section of a substantially triangular shape, tapered towards the inside of the sheet; according to further embodiments, the longitudinal section is substantially rectangular. It is clear that the shape of the section must be defined with reference to the possible return undergone by the material after the incision operations.

Figure 4B:
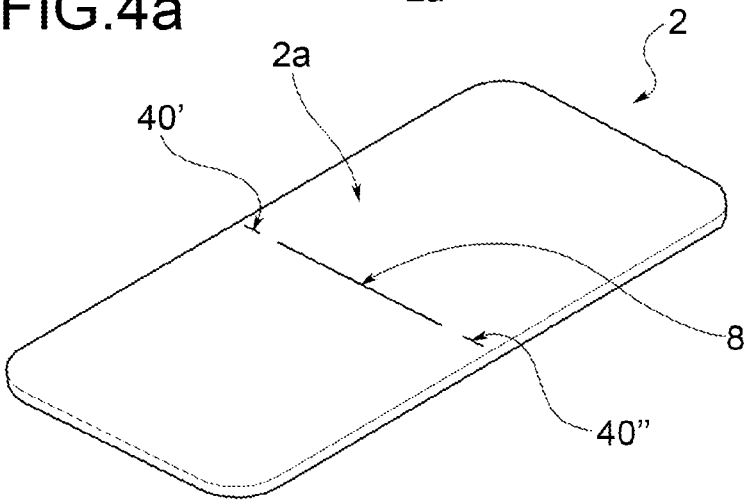

According to a further embodiment variant (FIG. 4*b*), the semi-rigid sheet 2 has at least one weakening, separate and preferably aligned with the inner incision 8, to facilitate the folding of the package.

Preferably, the rear face 2*a* of the semi-rigid sheet 2 has at least one weakening; for example, the rear face 2*a* has two weakenings 40', 40" placed side by side with the outer incision 8 and aligned with it. Preferably, each weakening consists of an incision; according to an embodiment variant, each weakening consists of a plurality of holes.

Said weakenings have a depth less than that (for example, minimum) of the outer incision 8; alternatively, said weakenings have a depth equal to that (for example, minimum) of the outer incision 8.

Figure 4C:
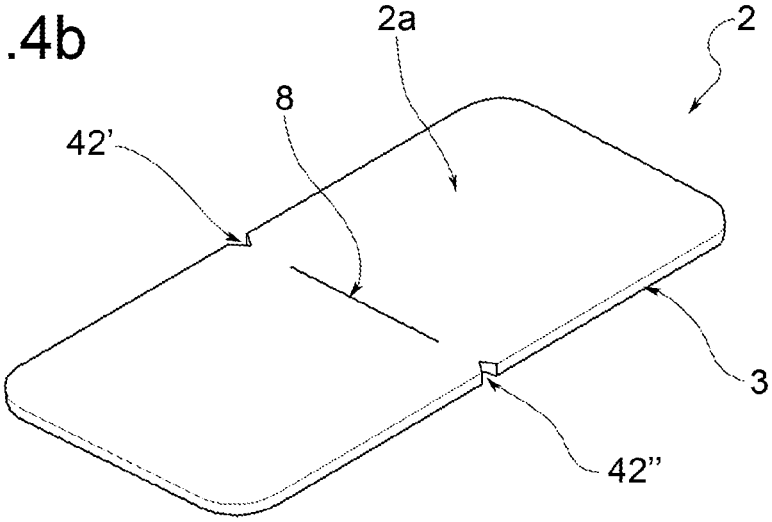
Figure 5:
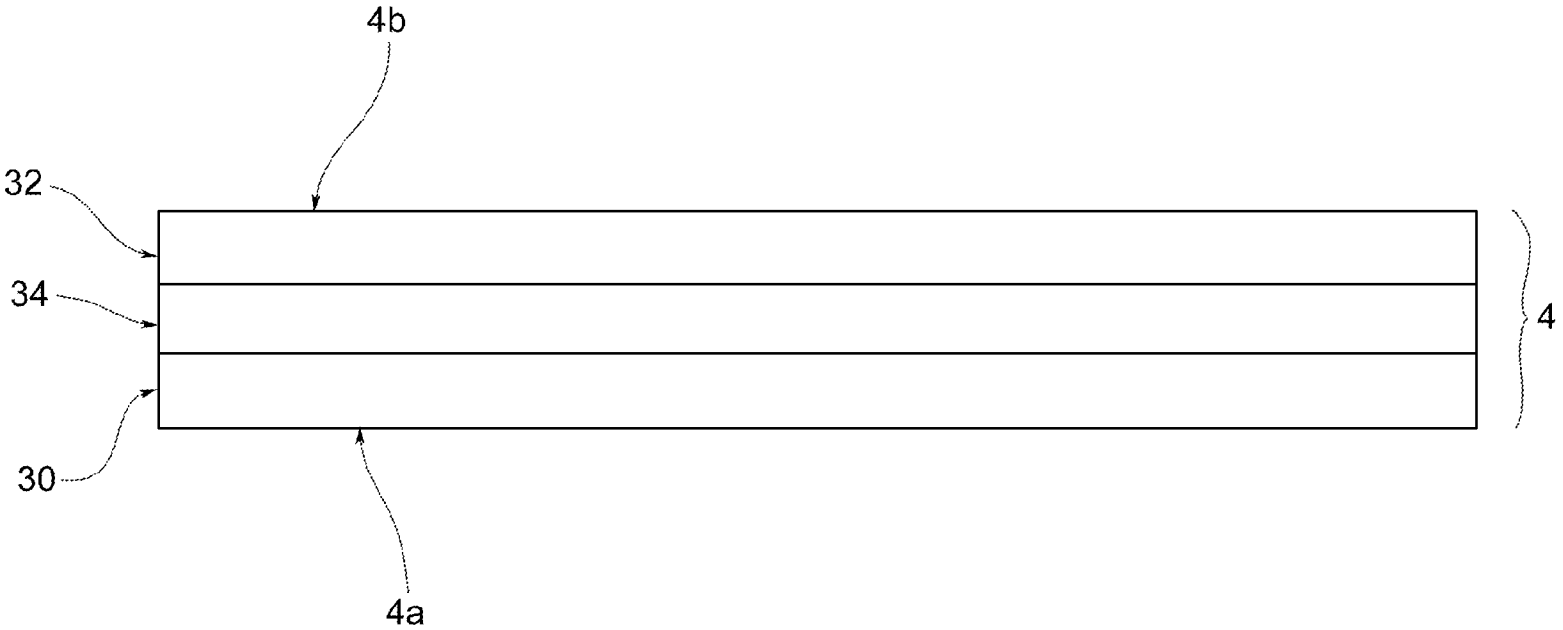
FIG. 5 shows a diagram of the multi-layer structure of a flexible sheet of the package according to an embodiment of the invention.
Figure 6:
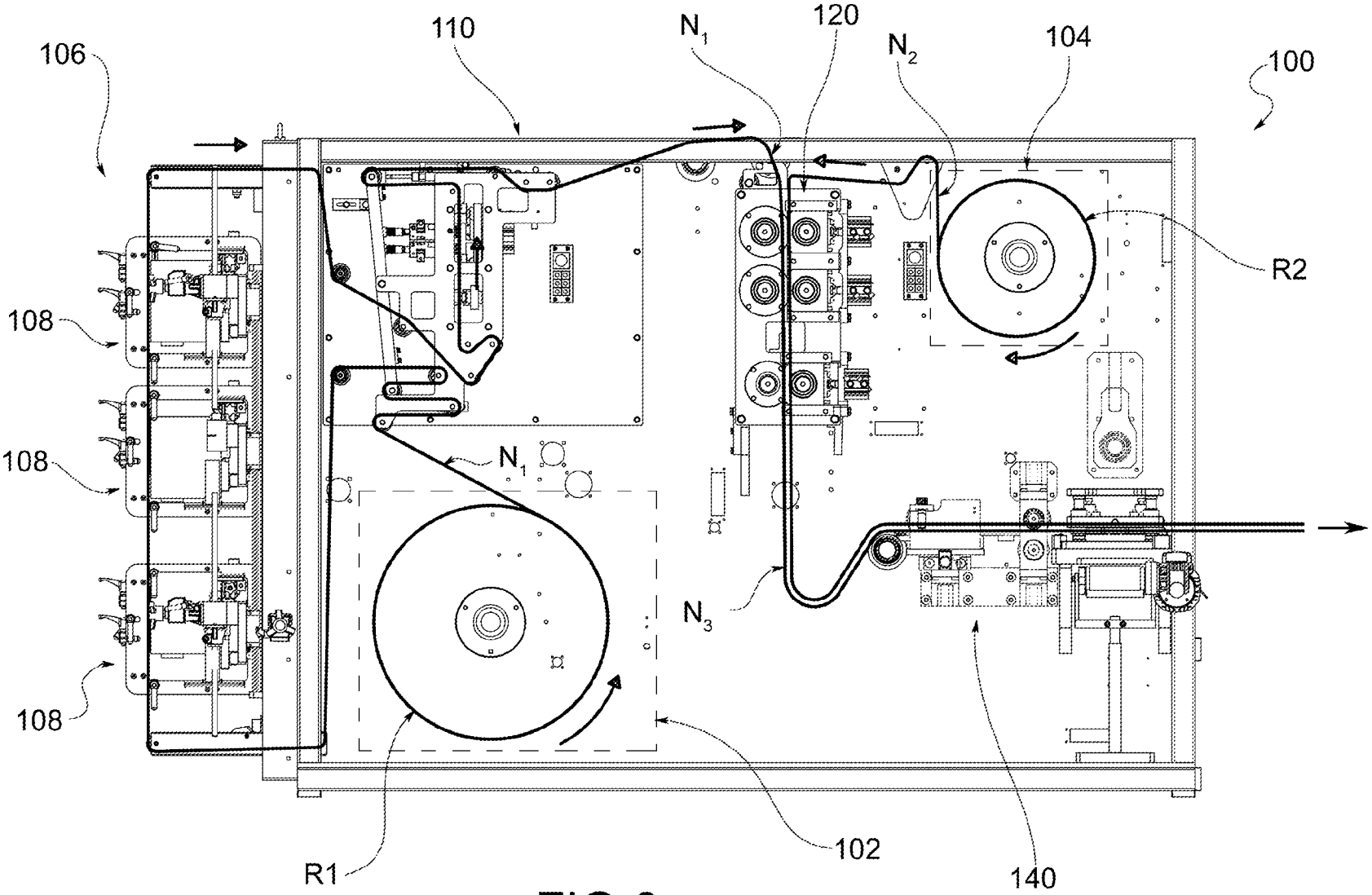
FIG. 6 shows a diagram of a machine for manufacturing a package according to the present invention.
Figure 7B:
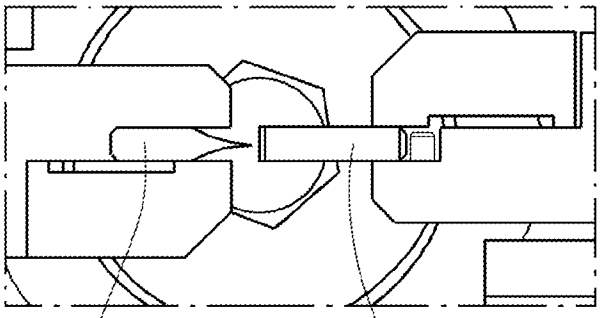
FIGS. 7*a* and 7*b* show diagrams of blades and abutments of an incision station of the machine of FIG. 6.
Figure 7A:
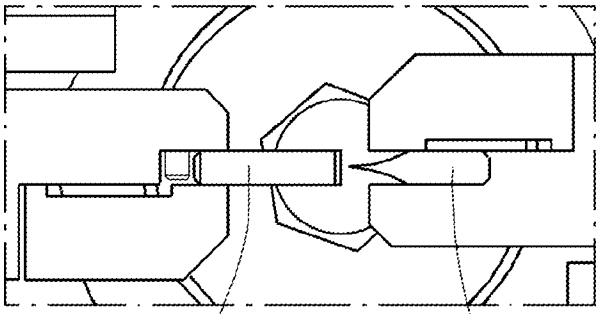

Alternatively (FIG. 4*c*), each weakening consists of a recess formed along the peripheral edge 3 of the semi-rigid sheet 2; for example, two recesses 42', 42" are provided, symmetrical with respect to the outer incision 8.

According to a further embodiment variant, the outer incision of the supporting layer does not join two points of the peripheral edge, but is interrupted before the edge, or it starts from a point of the peripheral edge and is interrupted before reaching the other point of the peripheral edge.

According to one embodiment, the outer incision of the supporting layer has a constant depth. According to one embodiment, the inner incision of the supporting layer has a constant depth.

According to an embodiment variant of the package according to the invention, the semi-rigid sheet has a circular or oval or polygonal, regular or mixed shape, i.e. consisting of rectilinear sections and arched sections.

In one embodiment, the supporting layer 10 has a compression zone around the apex of the outer incision 8, i.e. this compression zone is interposed between the outer incision 8 and the barrier layer 12. In said compression zone, the supporting layer 10 is permanently compressed.

In one embodiment, the barrier layer 12 comprises a split substantially aligned with the outer incision 8. In said embodiment variant, the supporting layer 10 constitutes a barrier to the passage of gas, and in particular to the passage of oxygen.

According to an embodiment, the outer incision 8 extends along a broken line 85, i.e. a line consisting of an ordered set of segments oriented consecutively (i.e. the second end of a segment coincides with the first end of the next segment) and not adjacently (i.e. a segment and the next segment do not belong to the same line).

In an embodiment variant, the broken line 85 comprises two lateral segments 86 which are identical in size and aligned with each other (i.e. one segment lies on the extension of the other). The broken line 85 further comprises a main line 87 which is substantially offset with respect to the two lateral segments 86 and by two joining segments 88 which are substantially parallel to each other and preferably are substantially perpendicular to the two lateral segments 86. In other words, each joining segment 88 connects an end of the lateral segment 86 to an end of the main line 87.

Figure 10A:
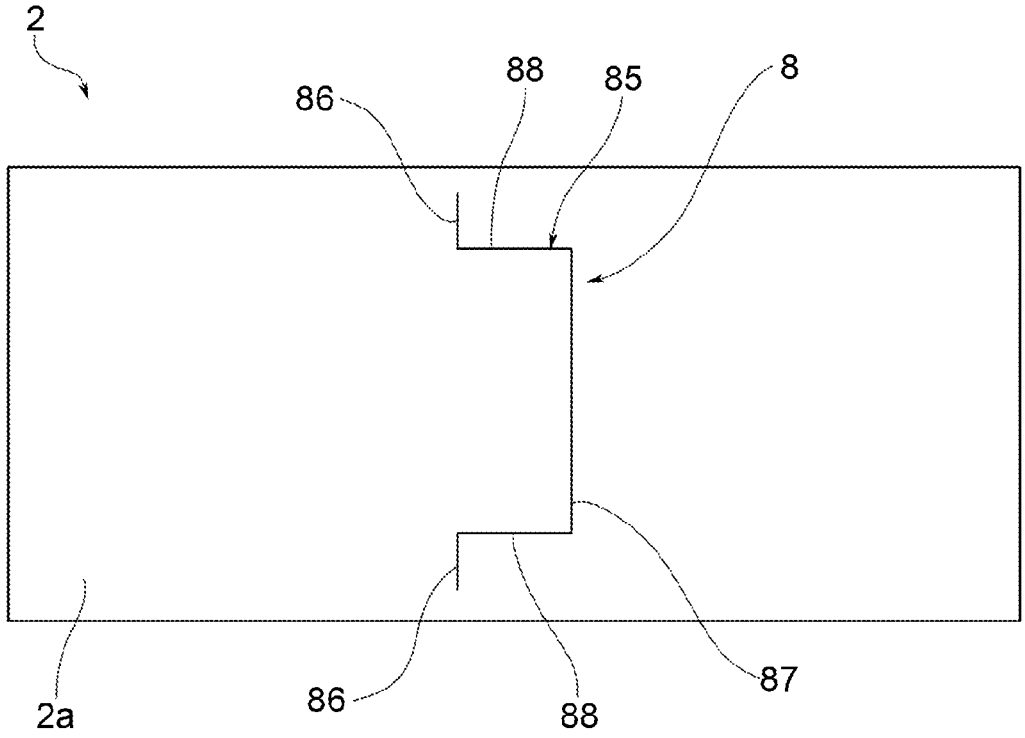
FIGS. 10*a*, 10*b*, 10*c*, 10*d* and 10*e* show further embodiments of the semi-rigid sheet according to the invention.

In a first embodiment (FIG. 10*a*), the main line 87 is a straight segment substantially parallel to the two lateral segments 86 and substantially perpendicular to the joining segments 88.

Figure 10B:
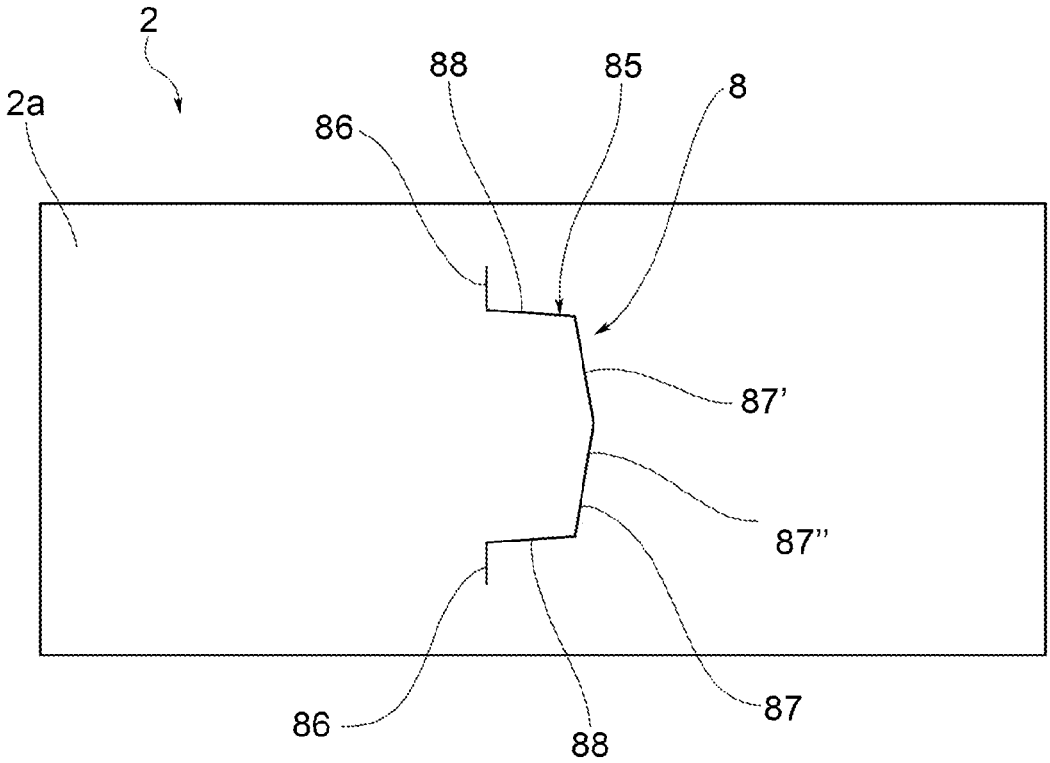
Figure 10C:
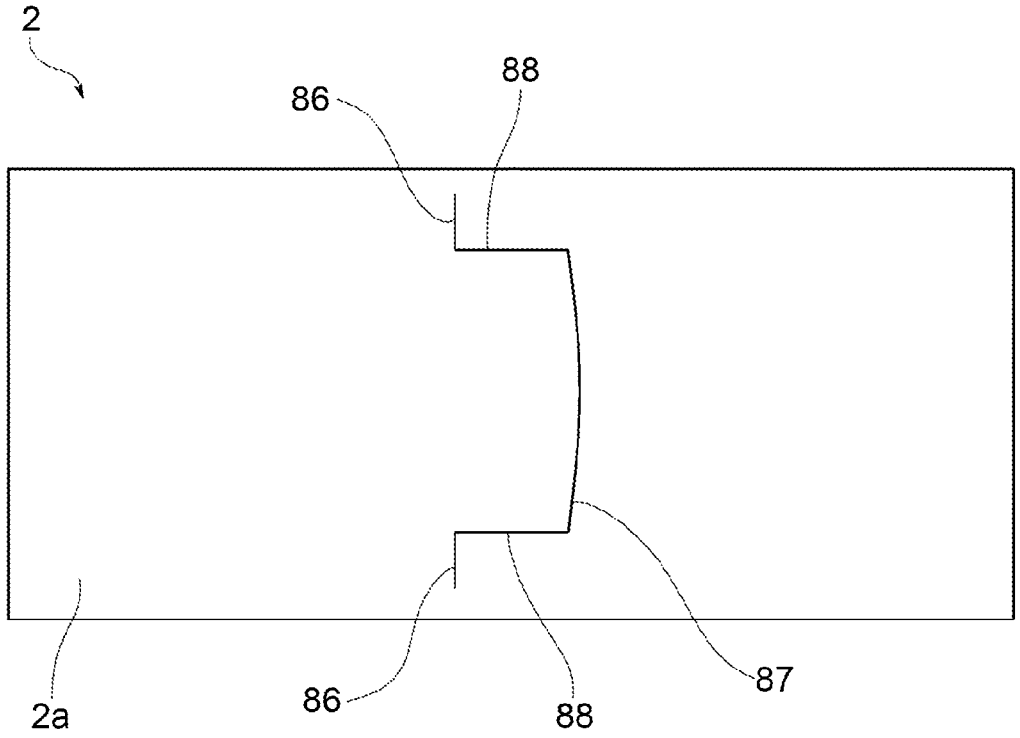
Figure 10D:
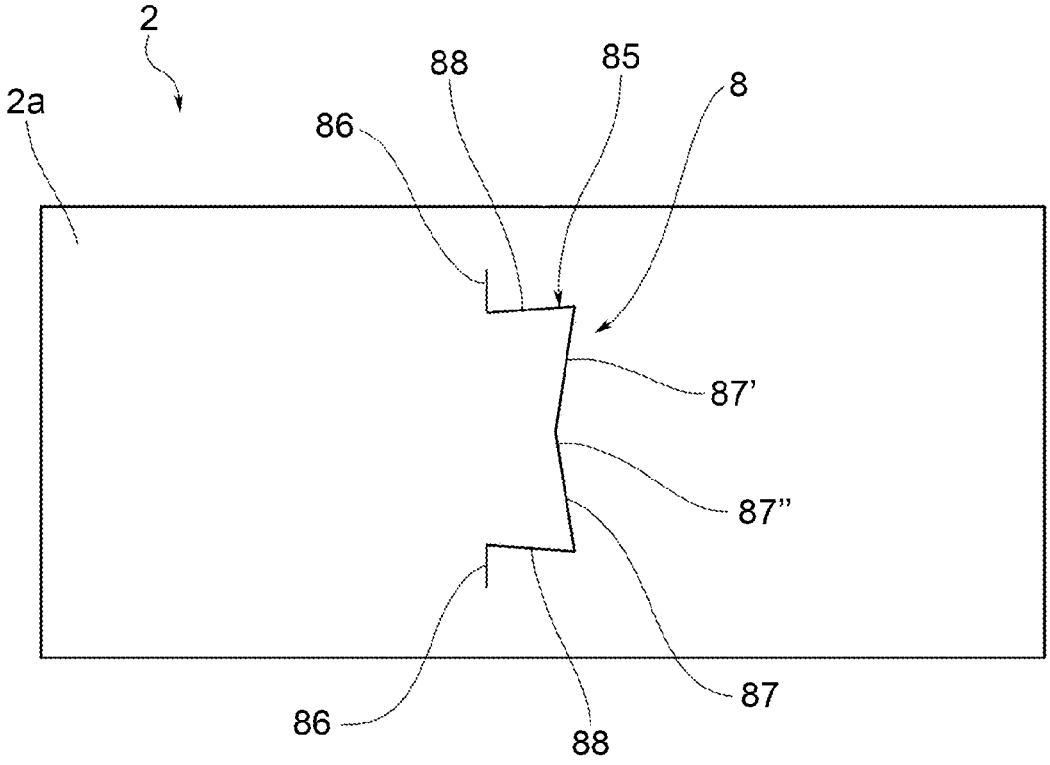

In a second embodiment (FIGS. 10*b*, 10*d*), the main line 87 comprises two straight segments 87', 87" which form an acute or obtuse angle with each other, i.e. they are not aligned. Said straight segments 87', 87" also form an acute or obtuse angle with the joining segments 88.

In a third embodiment (FIG. 10*c*), the main line 87 is an arc of circumference.

Figure 10E:
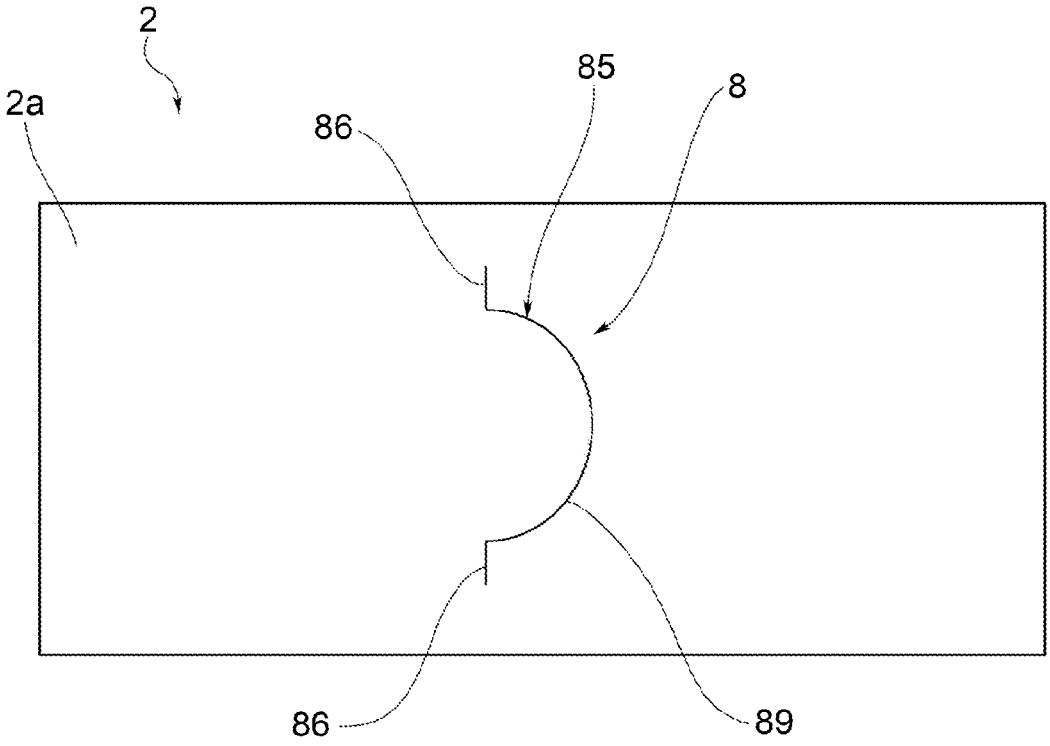

In a further embodiment variant (FIG. 10*e*), the broken line 85 comprises two lateral segments 86 which are identical in size and aligned with each other (i.e. one lies on the extension of the other). The broken line 85 further comprises an arc of circumference 89, preferably a semi-circle, which connects an end of a first lateral segment 86 to an end of a second lateral segment 86.

According to different embodiments, the two lateral segments 86 and/or the joining segments 88 may be linear, angled or curved.

Figure 8:
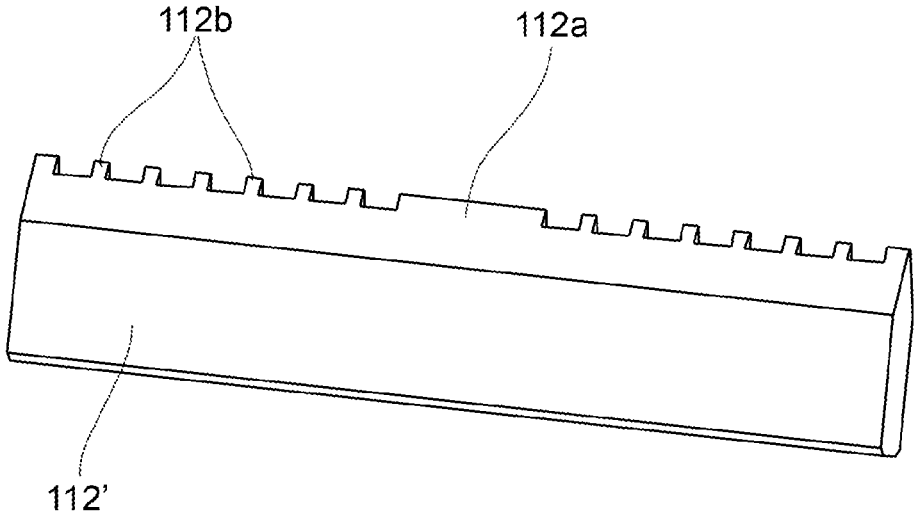
FIG. 8 shows the blade of FIG. 7*a* in one embodiment.

According to an embodiment (FIG. 8), the first blade 112' of the cutting station 110 comprises a main cutting edge 112*a* suitable for incising the surface of the first web N1 corresponding to the rear face 2*a* for making the outer incision 8. Furthermore, such first blade 112' comprises a plurality of secondary cutting edges 112*b* suitable for incising the surface of the first web N1 corresponding to the rear face 2*a* so as to form a plurality of secondary outer incisions 8'. These secondary outer incisions 8' lie on the extension of the outer incision 8, i.e. along the incision direction Y.

Advantageously, the secondary outer incisions 8' cooperate with the outer incision 8 in the break opening operations since they promote the opening of the single-dose package 1 along the incision direction Y.

According to an embodiment, said secondary cutting edges 112*b* are needle-like, thus the secondary outer incisions 8' are point-like incisions.

Figure 9:
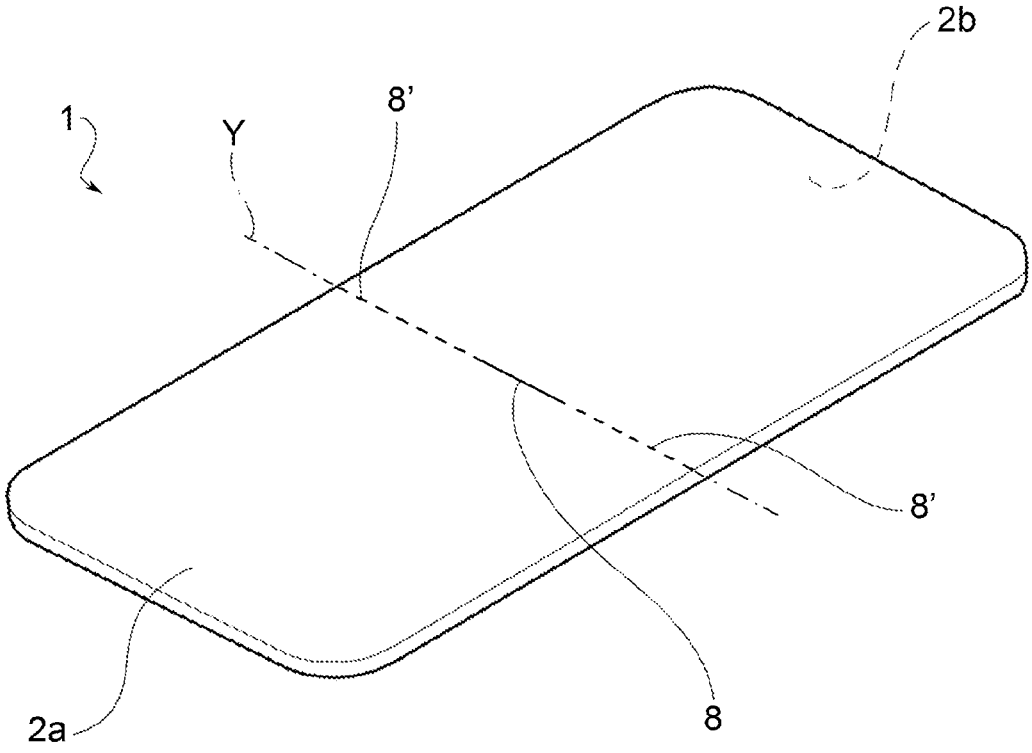
FIG. 9 shows an embodiment of the semi-rigid sheet according to the invention.

In a preferred embodiment (FIG. 9), the rear face 2*a* has the outer incision 8 which extends along the incision direction Y and the plurality of secondary outer incisions 8' arranged along said incision direction Y. Preferably, the secondary outer incisions 8' are arranged on both sides of the outer incision 8.

According to an embodiment, the secondary outer incisions 8' have a substantially lower depth with respect to the front face 2*b* than the depth H of the outer incision 8.

Innovatively, the package according to the present invention overcomes the drawbacks mentioned with reference to the prior art, since it allows having a package having a very low environmental impact, and in particular recyclable with paper.

It is clear that those skilled in the art may make changes to the package and the manufacturing method described above in order to meet incidental needs, all falling within the scope of protection defined in the following claims.

The invention claimed is:

1. A sealed single-dose package comprising a multi-layer semi-rigid sheet having a rear face and a front face opposite to the rear face, and a flexible sheet having an inner face and an outer face, the flexible sheet overlapping the multi-layer semi-rigid sheet so that the inner face faces the front face and is welded to the front face to form an inner pocket for containing one dose of a product, wherein an outer incision extending along an incision direction is provided on the rear face of the multi-layer semi-rigid sheet, at the inner pocket, and an inner incision is provided on the front face;

wherein the multi-layer semi-rigid sheet comprises a supporting layer having said rear face made of paper, cardboard, or other cellulose-based material, and wherein the outer incision has a depth and extends exclusively through said supporting layer of the multi-layer semi-rigid sheet, a barrier layer suitable for providing a barrier against the passage of gas, and a final layer having said front face, comprising polyethylene or polypropylene or a solder varnish or other material suitable for being welded to the flexible sheet;

wherein the flexible sheet comprises an outer layer having said outer face made of paper, cardboard, or other predominantly cellulose-based material, and an inner layer having said inner face, comprising polyethylene or polypropylene or a solder varnish or other material suitable for being welded to the multi-layer semi-rigid sheet, wherein the rear face has a plurality of secondary outer incisions arranged along the incision direction, on both sides of the outer incision, and wherein the paper, cardboard, or predominantly cellulose-based material forms at least 60% by weight of a weight of the sealed single-dose package.

2. The sealed single-dose package of claim 1, wherein said secondary outer incisions have a lower depth with respect to the front face than the depth of the outer incision.

3. The sealed single-dose package of claim 2, wherein the outer incision has a varying depth with respect to the rear face.

4. The sealed single-dose package of claim 1, wherein the outer incision has a substantially triangular longitudinal section.

5. The sealed single-dose package of claim 1, wherein the inner incision is misaligned with the outer incision, the inner incision not overlapping or only partially overlapping the outer incision.

6. The sealed single-dose package of claim 1, wherein the inner incision is aligned with the outer incision, the inner incision completely overlapping the outer incision.

7. The sealed single-dose package of claim 1, wherein the supporting layer has barrier properties against the passage of gas.

8. The sealed single-dose package of claim 1, wherein the multi-layer semi-rigid sheet further comprises at least one intermediate layer comprising an adhesive or polyethylene, or polypropylene, or other material binding with the supporting layer.

9. The sealed single-dose package of claim 8, wherein said polyethylene is extruded polyethylene.

10. The sealed single-dose package of claim 8, wherein said polypropylene is extruded polypropylene.

11. The sealed single-dose package of claim 1, wherein the flexible sheet further comprises an intermediate layer having barrier properties against the passage of gas.

12. The sealed single-dose package of claim 1, wherein the outer layer of the flexible sheet has barrier properties against the passage of gas.

13. The sealed single-dose package of claim 1, wherein the supporting layer of the multi-layer semi-rigid sheet comprises a permanent compression area about an apex of the outer incision.

14. The sealed single-dose package of claim 1, wherein the outer incision extends along a broken line, and wherein said broken line comprises two lateral segments, a main line and two joining segments.

15. The sealed single-dose package of claim 14, wherein the main line is an arc of circumference.

16. The sealed single-dose package of claim 1, wherein the outer incision extends along a broken line, and wherein said broken line comprises two lateral segments and an arc of circumference that connects an end of a first lateral segment of said two lateral segments to an end of a second lateral segment of said two lateral segments.

* * * * *